US005198317A

United States Patent [19]

Osawa et al.

[11] Patent Number: 5,198,317

[45] Date of Patent: Mar. 30, 1993

[54] ORGANIC PHOTOSENSITIVE MEMBER COMPRISING A CHARGE TRANSPORT LAYER WITH A BINDER RESIN AND A SOLVENT

[75] Inventors: Izumi Osawa, Ikeda; Shuji Iino, Hirakata; Isao Doi, Toyonaka; Kenji Masaki, Ibaraki, all of Japan

[73] Assignee: Minolta Camera Kabushiki Kaisha, Osaka, Japan

[21] Appl. No.: 652,646

[22] Filed: Feb. 8, 1991

[30] Foreign Application Priority Data

Feb. 9, 1990 [JP] Japan ..... 2-30207

[51] Int. Cl.[5] ..... G03G 5/14

[52] U.S. Cl. ..... 430/58; 430/66; 430/132

[58] Field of Search ..... 430/58, 66, 132

[56] References Cited

U.S. PATENT DOCUMENTS

| | | | |
|---|---|---|---|
| 4,755,444 | 7/1988 | Karakida et al. | 430/66 |
| 4,882,256 | 11/1989 | Osawa et al. | 430/66 |
| 4,886,724 | 12/1989 | Masaki et al. | 430/66 |
| 4,906,544 | 3/1990 | Osawa | 430/66 |

*Primary Examiner*—Marion E. McCamish
*Assistant Examiner*—S. Rosasco
*Attorney, Agent, or Firm*—Burns, Doane, Swecker & Mathis

[57] ABSTRACT

The present invention relates to a photosensitive member comprising a conductive substrate; an organic photosensitive layer formed on the conductive substrate, and containing a solvent at a content of 2,500 ppm or more; and a surface protective layer formed on the organic photosensitive layer, which is composed of an amorphous hydrocarbon having an absorptivity coefficient of 400 to 5,000 $cm^{-1}$ with respect to light of 450 nm wavelength.

7 Claims, 2 Drawing Sheets

ORGANIC PHOTOSENSITIVE MEMBER COMPRISING A CHARGE TRANSPORT LAYER WITH A BINDER RESIN AND A SOLVENT

BACKGROUND OF THE INVENTION

The present invention relates to a photosensitive member, and more particularly, to an organic photosensitive member having a surface protective layer thereon.

Recently prevailing are organic photosensitive members composed of an organic photoconductive material dispersed in a binding resin, since they are more hygienically handled, and more suited for commercial production than those made of selenium, cadmium sulfide, or the like.

The organic photosensitive members are, however, low in hardness, and therefore, are easily abraded and flawed due to the friction with transfer paper, cleaning members, and a developer during their repeated workings.

To eliminate these problems, there is proposed a surface protective layer with a high hardness formed on the surface of an organic photosensitive member.

For example, amorphous hydrocarbon is a well known material for such a surface protective layer featured by high hardness as shown in Japanese Patent Unexamined Publication Nos. Sho 63-97962, Hei 1-4754, and Hei 1-86158 which disclose techniques of forming a surface protective layer of amorphous hydrocarbon on the surface of an organic photosensitive member.

Desirably, a surface protective layer is formed on organic photosensitive layer immediately after the formation of the organic photosensitive layer. But, as a matter of fact, organic photosensitive layers alone are first mass-produced at once, and then, amorphous hydrocarbon layers are formed thereon for simplification of manufacturing process, or due to a problem of machines such as difference in yield between an organic photosensitive layer forming apparatus and an amorphous hydrocarbon layer forming apparatus or the like. Generally, the period from the organic photosensitive layer forming step to the amorphous hydrocarbon layer forming step is several days to one month or so, during which the organic photosenstive layers are stored (this stored time is referred to as "stock time is process").

During this period, the organic photosensitive layers are oxidized at their surfaces with the passage of time by the oxygen in the atmosphere. It is to be noted that when an amorphous hydrocarbon layer is formed on an organic photosensitive layer having such an oxidized layer thereon, the amorphous hydrocarbon layer peels because of poor adhesivity of the amorphous hydrocarbon layer to the oxidized layer.

Generally, in forming organic photosensitive layers, an organic photosensitive material is dissolved or dispersed in a solution of a resin in a solvent, and the obtained solution or dispersion is applied to a conductive substrate and dried. During this drying step, the solvent is removed from the organic photosensitive layer to form pores therein, and hence, the organic photosensitive layer has a somewhat porous structure. In addition, the solvent contained in the organic photosenstive layer is further reduced during the above mentioned storing period which is fairly long, so that the pores in the organic photosensitive layer are considerably increased. If a photosensitive member is manufactured by forming an amorphous hydrocarbon layer on such a porous photosenstive layer, and employed in a copying machine, the residual potential on the photosenstive member is disadvantageously raised during its repeated workings.

The present invention is intended to overcome the above discussed problems, and to improve the conventional photosensitive member comprising a surface protective layer of amorphous hydrocarbon formed on an organic photosensitive layer.

SUMMARY OF THE INVENTION

The object of the present invention is to provide an organic photosensitive member with excellent photostatic characteristics by solving the problems of poor adhesivity of an organic photosensitive layer and an amorphous hydrocarbon layer, and of the rise in residual potential caused in repeated operations.

The present invention relates to a photosensitive member comprising a conductive substrate; an organic photosensitive layer formed on the conductive substrate, and containing a solvent at a content of 2,500 ppm or more; and a surface protective layer formed on the organic photosensitive layer, which is composed of an amorphous hydrocarbon having an absorptivity coefficient of 400 to 5,000 $cm^{-1}$ with respect to light of 450 nm wavelength.

This and other objects, features and advantages of the invention will become more apparent upon a reading of the following detailed specification and drawings.

DETAILED DESCRIPTION OF THE INVENTION

Figure 1:
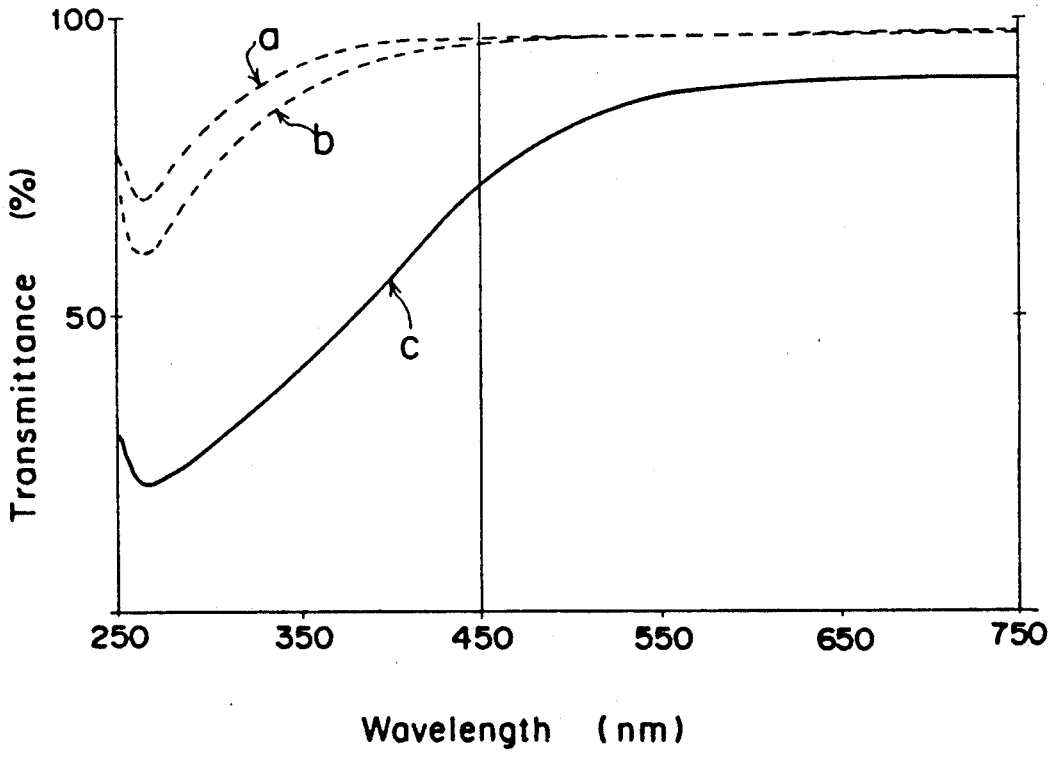
FIG. 1 is a graph for showing typical spectra of visible light passing through amorphous hydrocarbon layers.

The present invention provides a photosensitive member excellent in electrostatic stability, even after repeated use.

The present invention has accomplished the above object by specifying a content of a solvent in a photosensitive layer and an absorptivity coefficient of a surface protective layer. The peeling of an amorphous hydrocarbon layer due to the presence of an oxidized layer formed on an organic photosenstive layer, and the rise in residual potential can be improved by rinsing the surface of the organic photosensitive layer with a solvent before forming an amorphous hydrocarbon layer so as to remove the oxidized layer, and also by adjusting the solvent content of the organic photosensitive layer to 2,500 ppm or more. As described above, the organic photosensitive layer has a porous structure, and the amorphous hydrocarbon layer formed thereon also has a porous structure resulting from its manufacturing method and has a property to easily adsorb ozone or other active gases, so that the active gases adsorbed into the amorphous hydrocarbon layer enter the organic photosensitive layer through the pores thereof, and deteriorate the charge-transporting material and the charge-generating material (i.e., deterioration in carrier mobility of the charge-transporting material, or deterioration in quantum efficiency of the charge-generating material), thereby raising the residual potential of the photosensitive member. Accordingly, when the oxidized layer is removed on the photosensitive layer with a solvent, the organic photosensitive layer is allowed to absorb the solvent at a content of 2,500 ppm or more so that the pores of the organic photosensitive layer can be occupied with the solvent. Thus, the charge-transporting material or charge-generating material can be prevented from being deteriorated due to the active gases, and hence, the problems of poor adhesivity and of rise in residual potential can be improved.

It is to be noted that this photosensitive member has a problem that its initial surface potential ($V_0$) becomes low. The following are the reasons therefor: as mentioned above, the amorphous hydrocarbon layer has a porous structure and hence has a number of dangling bonds which adsorb much of ozone, NOx or other active gases. The active gases adsorbed into the amorphous hydrocarbon layer oxidize the solvent contained in the photosensitive layer, thereby lowering the electric resistance of the solvent. And this fall in electric resistance is supposed to lower the initial surface potential ($V_0$) of the photosensitive layer.

The present inventors further studied the characteristics of the amorphous hydrocarbon layer, and found that its characteristics were notably varied depending on its absorptivity coefficient with respect to light of 450 nm wavelength (hereinafter referred to as $\alpha_{450\ nm}$), and that when $\alpha_{450\ nm}$ is set within the range of 400 to 5,000 ($cm^{-1}$), the fall in initial surface potential as mentioned above can be improved.

As described above, the amorphous hydrocarbon layer has a porous structure, and its pores are considered to have a close relationship with the absorptivity coefficient ($\alpha_{450\ nm}$) of the amorphous hydrocarbon layer. In the case of an amorphous hydrocarbon layer abundant in hollow pores, the absorptivity coefficient is increased since light is scattered in the hollow pores, or since the dangling bonds which appear from the hollow pores absorb light. On the contrary, an amorphous hydrocarbon layer having a low absorptivity coefficient has a small number of hollow pores. Accordingly, by adjusting the $\alpha_{450\ nm}$ to 400 to 5,000 ($cm^{-1}$), the number of hollow pores in amorphous hydrocarbon layer may be decreased, and the active gases may be prevented from entering the organic photosensitive layer. Thus, the fall in initial surface potential of an organic photosensitive member caused when copying operations are repeatedly carried out may be eliminated. In addition, since an amorphous hydrocarbon layer showing an absorptivity coefficient of as low as 400 to 5,000 ($cm^{-1}$) is also low in internal stress, the problems brought about by a roughened surface of the amorphous hydrocarbon layer, which is caused by the relaxation of the internal stress in the course of the manufacturing process, is completely overcome.

In the present invention, an organic photosensitive layer per se known may be used.

In structure, the organic photosensitive layer may be a monolayer type photosensitive layer containing a photoconductive material dispersed in a binder, or a photosensitive layer having a charge-generating layer and a charge-transporting layer laminated in this order or in reverse order.

The solvent content of the organic photosensitive layer is adjusted to 2,500 to 20,000 ppm. If it is more than 20,000 ppm, the photosensitive layer does not harden sufficiently, so that the amorphous hydrocarbon layer is apt to crack.

The conductive substrate of the present invention may be any one so far as at least the uppermost surface thereof can exhibit conductivity, and may be optionally shaped, for example, cylindrically, into a flexible belt, a flat plate or the like.

The surface protective layer of the present invention is formed of amorphous hydrocarbon, and its absorptivity coefficient $\alpha_{450\ nm}$ is limited to 400 to 5,000 $cm^{-1}$, preferably, to 1,000 to 4,000 $cm^{-1}$. If it is greater than 5,000 $cm^{-1}$, the static characteristics of the photosensitive member are unstable (fall in initial surface potential). If it is less than 400 $cm^{-1}$, the amorphous hydrocarbon layer becomes low in hardness, resulting in poor durability.

The surface protective layer is 0.01 to 5 μm, preferably, 0.04 to 1 μm, and more preferably 0.08 to 0.5 μm in thickness. If its thickness is less than 0.01 μm, the layer strength is lowered, which will cause flaws and cracks in the layer. If it is more than 5 μm, there arise problems such as a decrease of sensitivity because of poor light transmittance, increase of residual potential, deterioration of layer forming properties, deterioration of adhesivity, and the like.

In the present invention, it is preferred that a visible light transmittance of the surface protective layer is 80% or more.

In the equation of $I=I_0 \exp(-\alpha d)$, to adjust 'I' to 80% or more of $I_0$, the following requirement must be satisfied:

$$\alpha d \leqq 0.223.$$

The amorphous hydrocarbon layer shows the highest absorptivity to light of 450 nm wavelength within the range of 450 to 780 nm wavelength which is generally used to irradiate a photosensitive member in a copying machine. Therefore, it is preferable that the following relationship between the absorptivity coefficient and the thickness of the surface protective layer is satisfied.

$$\alpha_{450\ nm} \times d \leqq 2{,}230$$

[in which $\alpha_{450\ nm}$ is the absorptivity coefficient ($cm^{-1}$) with respect to the light of 450 nm wavelength, and d is the thickness (μm) of the surface protective layer.]

The amount of hydrogen atoms contained in the amorphous hydrocarbon layer is not particularly limiting, but is inevitably limited to about 5 to 60 atomic % in terms of the structure of the surface protective layer and the manufacturing technique using glow discharge.

The respective amounts of the carbon atoms and the hydrogen atoms contained in the amorphous hydrocarbon layer can be measured by means of organic element analysis, SIMS analysis, or the like. Further, the amounts of the carbon atoms can be measured by means of Auger analysis.

The surface protective layer of the present invention is formed by means of a glow discharge decomposition technique: voltage is raised in gas-phase molecules containing at least carbon atoms and hydrogen atoms to cause a discharge phenomenon under a vacuum pressure, and the active, neutral species, or charged species contained in the generated plasma atmosphere are diffused, and introduced to the substrate by electric force or magnetic force, and deposited as a solid phase on the substrate through the recombination reaction. Briefly, the amorphous hydrocarbon layer is formed through what is called plasma chemical vapor deposition.

The above mentioned molecules are not always of gas-phase at an ordinary temperature under an ordinary pressure, but may be any one of liquid-phase or of solid-phase phase so far as they can be finally volatilized through a fused, vaporized, or sublimated state.

The molecules containing at least carbon atom and hydrogen atom are hydrocarbons such as saturated hydrocarbon, unsaturated hydrocarbon, cycloaliphatic hydrocarbon, aromatic hydrocarbon, and the like.

The absorptivity coefficient of an amorphous hydrocarbon layer can be controlled in accordance with conditions of layer forming process, such as pressure, discharge frequency, electric power, material gas, gas flow amount and the like.

The amorphous hydrocarbon layer formed by decomposing material gases with high energy has many dangling bonds therein, so that its absorptivity coefficient is increased.

To decrease the absorptivity coefficient of the amorphous hydrocarbon layer, the supplied energy per molecule for decomposition is lessened, and energy necessary only for forming a layer is supplied to each molecule so as not to cause unnecessary dangling bonds. It is to be noted that the supplied energy should not be excessively decreased. The reason is that when the supplied energy is too low, the bond strength between each of molecules required for forming an amorphous hydrocarbon layer becomes insufficient, resulting in poor hardness and low abrasion resistance.

Accordingly, the absorptivity coefficient of the amorphous hydrocarbon layer can be properly controlled by other various methods such as by increasing pressure, by decreasing electric power, by increasing gas flow amount, by employing hydrocarbon having many carbon atoms as a material gas, by increasing discharge frequency, by lowering substrate temperature, by shortening discharge time or the like. These controlling methods can be used singly or in their combination so that $\alpha_{450\ nm}$ of amorphous hydrocarbon layer can be adjusted to 400 to 5,000 $cm^{-1}$.

Specifically, in the present invention, by preparing an amorphous hydrocarbon layer under the conditions satisfying the following expression [I], the amorphous hydrocarbon having $\alpha_{450\ nm}$ of 400 to 5,000 $cm^{-1}$ can be efficiently obtained.

$$0.005 \leqq A \leqq 0.15 \quad [I]$$

in which

A: Pwr/(FR·Prs)

Pwr: supplied electric power [W]

FR: amount of introduced material gas [sccm]

Prs: pressure [Torr]

In the expression [I], if A is less than 0.005, the hardness of the obtained amorphous hydrocarbon layer is low, resulting in poor durability. If it is greater than 0.15, the absorptivity coefficient of the obtained amorphous hydrocarbon layer is apt to be large.

The following examples are included merely to aid in the understanding of the invention, and variation may be made by one skilled in the art without departing from the spirit and scope of the invention.

Formation of Photosensitive Layer

Formation of Organic Photosensitive Layer (a)

A liquid mixture of 1 part by weight of bisazo pigment of chlorodian blue (CDB), 1 part by weight of a polyester resin (V-200; made by TOYOBO K.K.), and 100 parts by weight of cyclohexanone was dispersed for 13 hours by means of a sand grinder. A cylindrical aluminum substrate (80 mm diameter×330 mm length) was dipped in this dispersion to be coated therewith, and dried so that a charge-generating layer of 0.3 μm thickness was formed on the substrate.

In the meantime, 1 part by weight of 4-diethylaminobenzaldehyde-diphenylhydrazone (DEH) and 1 part by weight of polycarbonate (K-1300; made by Teijin Kasei K.K.) were dissolved in 6 parts by weight of tetrahydrofuran (THF). The obtained solution was applied to the charge-generating layer, and dried at 100° C. for 45 minutes so that a charge-transporting layer of 15 μm thickness was formed. Thus, an organic photosensitive layer (a) was obtained.

The solvent content of the organic photosensitive layer (a) was 1,520 ppm.

To determine the solvent content, the residual solvent was extracted from the photosensitive layer, and analyzed by means of a gas chromatography to determine the solvent content. More particularly, a part of the photosensitive layer was precisely measured, and immersed in a solvent such as acetone, methyl ethyl ketone, tetrahydrofuran, ethanol or the like. Then, the residual solvent in the photosensitive layer was extracted by the help of ultrasonic vibration or the like. An internal standard substance such as benzene, toluene, xylene, hexane, or the like was added to the extract, and the obtained mixture was determined by a gas chromatography in accordance with the internal standard method.

Formation of Organic Photosensitive Layer (b)

A liquid mixture of 25 parts by weight of special α type copper phthalocyanine (made by Toyo Ink K.K.), 50 parts by weight of acrylic melamine thermosetting resin (a mixture of A-405 and Super Beckamine J820; made by Dainippon Ink K.K.), 25 parts by weight of 4-diethylaminobenzaldehyde-diphenylhydrazone, and 500 parts by weight of an organic solvent (a mixture of 7 parts by weight of xylene and 3 parts by weight of butanol) was ground and dispersed for 10 hours in a ball mill. A cylindrical aluminum substrate (80 mm diameter×330 mm length) was dipped in the obtained dispersion to be coated therewith, dried at a normal temperature, and baked at 150° C. for one hour. Thus, an organic photosensitive layer (b) of 15 μm thickness was obtained.

The solvent content thereof was 1,140 ppm.

Formation of Organic Photosensitive Layer (c)

Two parts by weight of bisazo compound represented by the following formula Ia, 1 part by weight of a polyester resin (V-500; made by TOYOBO K.K.), and 100 parts by weight of methyl ethyl ketone were stirred for 24 hours to disperse the same in a ball mill. Then, a cylindrical aluminum substrate (80 mm diameter×330 mm length) was dipped in this dispersion to be coated therewith, and dried so that a charge-generating layer of 3,000 Å thickness was formed.

[Ia]

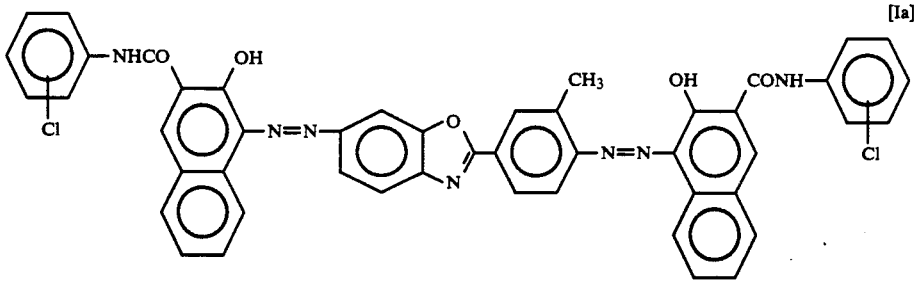

Then, 10 parts by weight of hydrazone compound represented by the following formula Ib, and 10 parts by weight of polycarbonate resin (K-1300; made by Teijin Kasei K.K.) were dissolved in 80 parts by weight of tetrahydrofuran. The obtained solution was applied to the above mentioned charge-generating layer, and dried at 80° C. for one hour so that a charge-transporting layer of 20 μm thickness was formed. Thus, an organic photosensitive layer (c) was obtained.

[Ib]

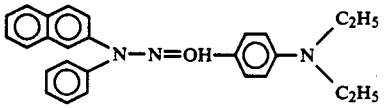

The solvent content of the organic photosensitive layer (c) was 1,900 ppm.

Formation of Organic Photosensitive Layer (d)

Two parts by weight of bisazo compound represented by the following formula IIa, 1 part by weight of polyester resin (V-500; made by TOYOBO K.K.), and 100 parts by weight of methyl ethyl ketone were stirred for 24 hours to disperse the same in a ball mill. Then, a cylindrical aluminum substrate (80 mm diameter×330 mm length) was dipped in this dispersion to be coated therewith, and dried so that a charge-generating layer of 2,500 Å thickness was formed.

[IIa]

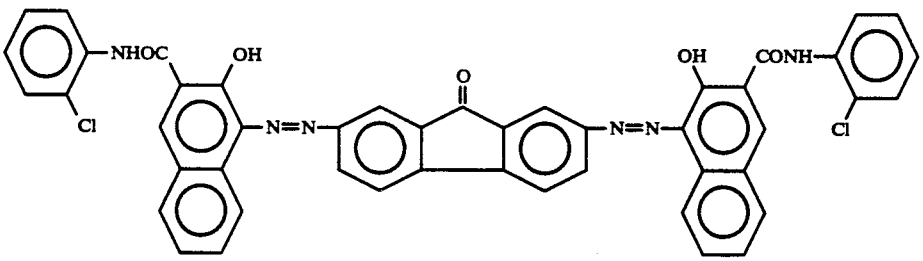

Then, 10 parts by weight of styryl compound represented by the following formula IIb, and 10 parts by weight of a polyarylate resin (U-4000; made by Yunichica K.K.) were dissolved in 85 parts by weight of tetrahydrofuran. The obtained solution was applied to the above mentioned charge-generating layer, and dried at 80° C. for 30 minutes so that a charge-transporting layer of 20 μm thickness was formed. Thus, an organic photosensitive (d) was obtained.

[IIb]

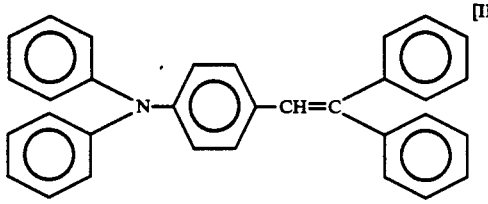

The solvent content of the organic photosensitive layer was 2,120 ppm.

Formation of Organic Photosensitive Layer (e)

Two parts by weight of a bisazo compound represented by the following formula IIIa, 1 part by weight of a polyester resin (V-500; made by:TOYOBO K.K.), and 100 parts by weight of methyl ethyl ketone were stirred for 24 hours to disperse the same with a ball mill. Then, a cylindrical aluminum substrate (80 mm diameter×330 mm length) was dipped in this dispersion to be coated therewith, and dried so that a charge-generating layer of 3,000 Å thickness was formed.

[IIIa]

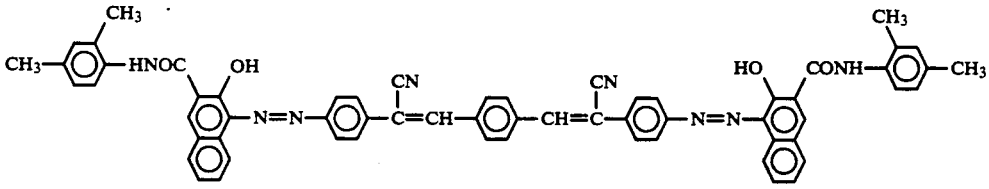

Then, 10 parts by weight of a styryl compound represented by the following formula IIIb, and 10 parts by weight of a methyl methacrylate resin (BR-85; made by Mitsubishi Rayon K.K.) were dissolved in 80 parts by weight of tetrahydrofuran. The obtained solution was applied to the above mentioned charge-generating layer, and dried at 70° C. for 30 minutes so that a charge-transporting layer of 20 μm thickness was formed. Thus, an organic photosensitive layer (e) was obtained.

[IIIb]

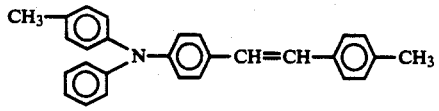

The solvent content of the organic photosensitive layer was 2,380 ppm.

Formation of Organic Photosensitive Layer (f)

Titanyl phthalocyanine (TiOPc) was deposited at a boat temperature of 400° to 500° C. under the atmosphere of a vacuum degree of $10^{-4}$ to $10^{-6}$ Torr according to a resistive heating method so that a TiOPc deposited layer of 2,500 Å thickness was formed as a charge-generating layer.

Then, 1 part by weight of p,p-bisdiethylaminotetraphenylbutadien represented by the following formula IV and 1 part by weight of polycarbonate (K-1300; made by Teijin Kasei K.K.) were dissolved in 6 parts by weight of THF. The obtained solution was applied to the above mentioned charge-generating layer, and dried at 100° C. for 30 minutes so that a charge-transporting layer of 15 μm thickness was formed. Thus, an organic photosensitive layer (f) was obtained.

[IV]

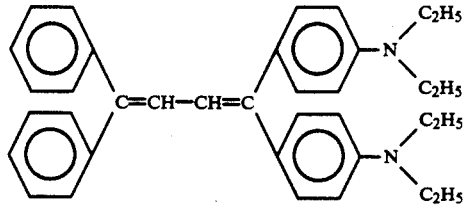

The solvent content of the organic photosensitive layer (f) was 1,670 ppm.

In this connection, among these organic photosensitive layers (a) to (f), the photosensitive layer (b) is used for positive electrification, and the remaining are used for negative electrification. In addition, the photosensitive layer (f) is used for exposure to light of a long wavelength, and the remaining are used for normal exposure.

Formation of Surface Protective Layer

Example 1

The organic photosensitive layer (a) having the solvent content of 1,520 ppm was dipped in Flon R113 for one minute to wash its surface, and dried at a normal temperature. It was then set in the vacuum tank of the apparatus shown in Japanese Patent Unexamined Publication No. Sho-97962. The solvent content of the organic photosensitive layer after being washed was 4,200 ppm which was measured just before starting a plasma reaction.

Then, 600 sccm of hydrogen gas and 600 sccm of butadiene gas were introduced into the vacuum tank to adjust the internal pressure to 2 Torr.

When the pressure in the tank was stabilized, an electric power of 50 W was supplied from a power source of 80 KHz frequency.

The above defined A value (refer to the expression [1]) was 0.0208, and the temperature of the photosensitive layer was 50° C.

Layer forming process was carried out for 230 seconds, so that a photosensitive member having an amorphous hydrocarbon layer of 0.1 μm thickness as a surface protective layer was obtained.

The $\alpha_{450\ nm}$ was 2,000 [l/cm], and the value of $d\cdot\alpha_{450\ nm}$ was 200.

The residual potential and the surface potential of the photosensitive member were evaluated. Furthermore, the pencil hardness thereof was 9 H. Table 1 shows the results.

The absorptivity coefficient $\alpha_{450\ nm}$ was measured as follows: the amorphous hydrocarbon layer was prepared on a transparent glass substrate (for example, #7059; made by Corning K.K.), and a spectrum of transmitted visible light was measured by a visible ultraviolet photometer (for example, UVIDEC-610 type: made by Nippon Bunkokogyo K.K.).

FIG. 1 is a graph showing the typical spectra of transmitted visible light, in which the curves (a) and (b) (with respect to the amorphous hydrocarbon layers (a) and (b)) are high in transmittance, namely, low in absorptivity coefficient $\alpha_{450\ nm}$ with respect to light of 450 nm, and in which the curve (c) (with respect to the amorphous hydrocarbon layer (c)) is high in absorptivity coefficient $\alpha_{450}$ nm.

The glass substrate was partially masked to have a non-coated area, and the difference in thickness between the coated area and the non-coated area was measured with a roughness measuring apparatus (for example, Surfcom 550A; made by Tokyo Seimitsu K.K.).

Then, the value of $\alpha$ was calculated according to the following equation.

$$\alpha\lambda = -(1/D)\cdot\log_e(I\lambda/Io\lambda)$$

(in which $\alpha\lambda$ is the absorptivity coefficient with respect to light of a wavelength $\lambda$, D is the film thickness, and $I\lambda/Io\lambda$ is the transmittance with respect to the light of the wavelength $\lambda$).

The reason why $\alpha$ was evaluated with respect to the light of 450 nm is that photosensitive members are used usually within a specific visual sensitivity range (450 to 650 nm), or within a range sensitive to a light-emitting diode or semiconductor laser (680 to 780 nm). Therefore, amorphous hydrocarbon layers are required to transmit the light at least within such ranges. It is no use to evaluate the transmittance characteristics of a light other than the above specified light. Accordingly, the light of 450 nm which was the most convenient to evaluate variation in $\alpha$ was selected from the above specified wavelength ranges.

Figure 2:
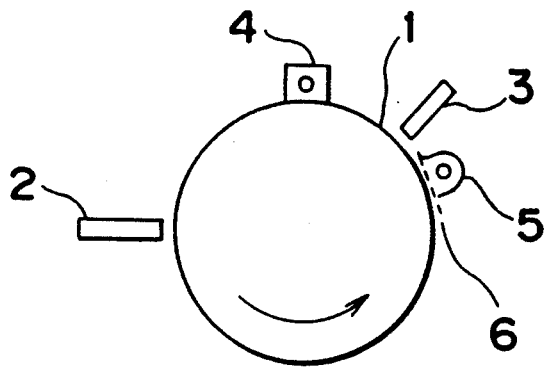
FIG. 2 shows a schematic constitutional view of a tester for measuring the residual potential of a photosensitive member.

The residual potential was evaluated by such a tester as shown in FIG. 2. A power of charger (4) was adjusted so that the monitor value sensed by a first surface potentiometer (2) could be constantly kept at $-500\pm20$ V. With respect to the photosensitive member (b), the monitor value was maintained at $+500\pm20$ V.

A halogen lamp was used as a static eliminating lamp (5), and it was turned on at a color temperature of 2,800° K. to irradiate a photosensitive member (1) through a filter (6) so that the photosensitive member (1) could be exposed to a light amount of 30 [lux sec.], with the exception that the static eliminating lamp (5) was turned on at a color temperature of 2,200° K. in the case of the photosensitive member (f).

The photosensitive member (1) was formed cylindrically (ϕ80 mm×1 330 mm), and was revolved at a circumferential speed of 13 cm/sec. in operation.

The residual potential was evaluated based on the monitor value sensed by a second surface potentiometer (3). The evaluation was made with symbols o, Δ, and x, based on the difference between the residual potential (Vr') measured after 5,000 times of revolution of the photosensitive member (1) and the residual potential (Vr) measured after the first revolution of the same.

o: $|Vr'-Vr| \leqq 50$

Δ: $50 < |Vr'-Vr| \leqq 100$ x: $100 < |Vr'-Vr|$

Figure 3:
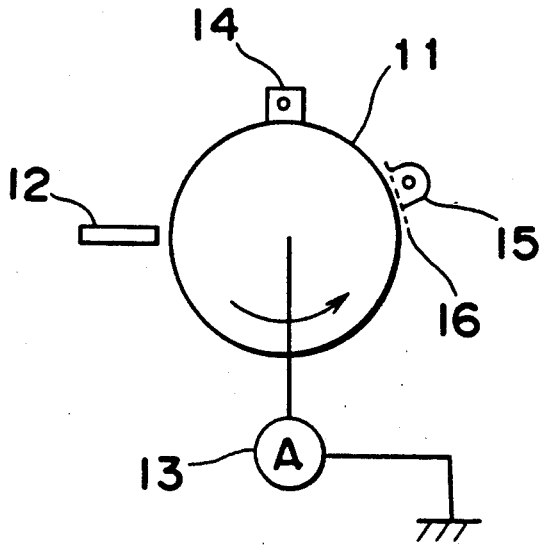
FIG. 3 shows a schematic constitutional view of a tester for measuring the fall in surface potential of the photosensitive member.

The fall in surface potential was evaluated with a tester as shown in FIG. 3. A charger (14) is adjusted with respect to a photosensitive member without an overcoating layer so that the monitor value of a surface potentiometer (12) could be constantly kept at −500±20 V. As for the photosensitive layer (b), the monitor value was kept at +500±20 V.

A halogen lamp was employed as a static eliminating lamp (15), and it was turned on at a color temperature of 2,800° K., and irradiated the photosensitive member (11) through a filter (16) so that the photosensitive member (11) could be exposed to light amount of 30 lux sec. As for the photosensitive layer (f), the lamp (15) was turned on at a color temperature of 2,200° K.

The photosensitive member (11) was formed cylindrically (80 mm diameter×330 mm length), and it was revolved at a circumferential speed of 13 cm/sec. in operation.

The monitor value of an ammeter (13) was recorded, and then, the output of the charger (14) was adjusted with respect to a photosensitive member having an overcoating layer thereon so that the monitor value of the surface potentiometer (12) could be kept at the above specified value, so as to load the photosenstive member with charge equal in amount to the photosensitive member without the overcoating layer.

The fall in surface potential was evaluated with symbols of o, Δ, and x, based on the difference between the surface potential ($V_0'$) of the photosenstive with the overcoating layer and the surface potential ($V_0$) of the photosensitive member without the overcoating layer.

o: $|V_0'-V_0| \leqq 50$

Δ: $50 < |V_0'-V_0| \leqq 100$ x: $100 < |V_0'-V_0|$

The surface hardness was measured as follows: an amorphous hydrocarbon layer, the thickness of which was 1,000 Å, was provided on a glass substrate, and the layer hardness was tested on the basis of pencil scratching test: JIS-K-5400 standards.

The evaluation was made as follows:

Pencil hardness

6 H or more o

H to 5 H Δ

F or less x

Examples 2 to 16 and Comparative Examples 1 to 6 shown in Table 1 were produced in the same manner as that of Example 1, with the exception that the producing conditions of the respective organic photosensitive layers and the respective surface protective layers were determined as shown in Table 1. In addition, the respective photosensitive members were evaluated in the same manner as those of Example 1.

TABLE 1

| | Organic photosensitive layer (solvent content ppm) | Solvent-increasing treatment | Residual solvent (ppm) | Material gases gas (sccm) | | gas (sccm) | | Total flow amount (sccm) |
|---|---|---|---|---|---|---|---|---|
| Com. Ex. 1 | a (1520) | dipped in Flon R113 | 4200 | hydrogen | 1000 | butadiene | 800 | 1800 |
| Ex. 2 | " | (CFC 12) 2 for 1 minute, | " | hydrogen | 800 | butadiene | 800 | 1600 |
| Ex. 3 | " | and dried at a normal | " | hydrogen | 800 | butadiene | 600 | 1400 |
| Ex. 4 | " | temperature. | " | hydrogen | 600 | butadiene | 600 | 1200 |
| Ex. 1 | " | | " | hydrogen | 600 | butadiene | 600 | 1200 |
| Ex. 5 | " | | " | hydrogen | 400 | butadiene | 300 | 700 |
| Ex. 6 | " | | " | hydrogen | 400 | butadiene | 150 | 550 |
| Ex. 7 | " | | " | hydrogen | 350 | butadiene | 50 | 400 |
| Com. Ex. 2 | " | | " | hydrogen | 300 | butadiene | 50 | 350 |
| Com. Ex. 4 | e (2380) | dipped in Flon R113 | 10000 | the same as Com. Ex. 1 | | | | |
| Ex. 8 | " | (CFC 12) 2 for 5 minutes, | " | the same as Ex. 2 | | | | |
| Ex. 9 | " | and dried at a normal | " | the same as Ex. 4 | | | | |
| Ex. 10 | " | temperature. | " | the same as Ex. 6 | | | | |
| Ex. 11 | " | | " | the same as Ex. 7 | | | | |
| Com. Ex. 5 | " | | " | the same as Com. Ex. 2 | | | | |
| Ex. 12 | b (1140) | (1) | 3400 | hydrogen | 800 | ethylene | 350 | 1150 |
| Ex. 13 | c (1900) | (2) | 6200 | hydrogen | 800 | propane | 350 | 1200 |
| Ex. 14 | d (2120) | (3) | 7100 | hydrogen | 800 | acetylene | 600 | 1400 |
| Ex. 15 | e (2380) | (4) | 10000 | hydrogen | 900 | propylene | 400 | 1300 |
| Ex. 16 | f (1670) | (5) | 5100 | helium | 700 | butadiene | 300 | 1000 |
| Com. Ex. 3 | b (1140) | non-treatment | 1140 | hydrogen | 300 | butadiene | 50 | 350 |
| Com. Ex. 6 | a (1520) | non-treatment | 1520 | hydrogen | 300 | butadiene | 50 | 350 |

| | Power (W) | Pressure (Torr) | A value | Freq. (Hz) | Ts (°C.) | Film forming time (sec.) | Film thickness d (μm) | Coefficient α 450 (1 cm) | d × α 450 | Residual potential | Surface potential | Pencil hardness |
|---|---|---|---|---|---|---|---|---|---|---|---|---|
| Com. Ex. 1 | 40 | 5 | 0.0044 | 80K | 50 | 180 | 0.1 | 350 | 35 | o | o | x |
| Ex. 2 | 40 | 5 | 0.005 | 80K | 50 | 190 | 0.1 | 400 | 40 | o | o | Δ |
| Ex. 3 | 50 | 4 | 0.0089 | 80K | 50 | 200 | 0.1 | 600 | 60 | o | o | Δ |
| Ex. 4 | 50 | 3 | 0.0139 | 80K | 50 | 210 | 0.1 | 1000 | 100 | o | o | o |
| Ex. 1 | 50 | 2 | 0.0208 | 80K | 50 | 230 | 0.1 | 2000 | 200 | o | o | o |
| Ex. 5 | 50 | 2 | 0.0357 | 80K | 50 | 240 | 0.1 | 3000 | 300 | o | o | o |
| Ex. 6 | 60 | 1 | 0.1091 | 80K | 50 | 260 | 0.1 | 4000 | 400 | o | o | o |

TABLE 1-continued

| | | | | | | | | | | | | |
|---|---|---|---|---|---|---|---|---|---|---|---|---|
| Ex. 7 | 60 | 1 | 0.15 | 80K | 50 | 280 | 0.1 | 5000 | 500 | ○ | Δ | ○ |
| Com. Ex. 2 | 70 | 1 | 0.2 | 80K | 50 | 300 | 0.1 | 6000 | 600 | ○ | x | ○ |
| Com. Ex. 4 | | | | the same as Com. Ex. 1 | | | | | | ○ | ○ | x |
| Ex. 8 | | | | the same as Ex. 2 | | | | | | ○ | ○ | Δ |
| Ex. 9 | | | | the same as Ex. 4 | | | | | | ○ | ○ | ○ |
| Ex. 10 | | | | the same as Ex. 6 | | | | | | ○ | ○ | ○ |
| Ex. 11 | | | | the same as Ex. 7 | | | | | | ○ | Δ | ○ |
| Com. Ex. 5 | | | | the same as Com. Ex. 2 | | | | | | ○ | x | ○ |
| Ex. 12 | 120 | 1.2 | 0.087 | 50K | 30 | 1800 | 0.75 | 2900 | 2175 | ○ | ○ | ○ |
| Ex. 13 | 100 | 1.4 | 0.0595 | 80K | 30 | 1150 | 0.75 | 2200 | 1100 | ○ | ○ | ○ |
| Ex. 14 | 50 | 1.6 | 0.0223 | 200K | 50 | 220 | 0.1 | 2200 | 220 | ○ | ○ | ○ |
| Ex. 15 | 40 | 1.8 | 0.0171 | * | 50 | 420 | 0.2 | 1300 | 260 | ○ | ○ | ○ |
| Ex. 16 | 30 | 2 | 0.015 | 80K | 30 | 200 | 0.1 | 1100 | 110 | ○ | ○ | ○ |
| Com. Ex. 3 | 70 | 1 | 0.2 | 80K | 50 | 300 | 0.1 | 6000 | 600 | x | ○ | ○ |
| Com. Ex. 6 | 70 | 0.8 | 0.25 | 80K | 50 | 320 | 0.1 | 10000 | 1000 | x | ○ | ○ |

(Remarks)
(1) dipped in Flon R113 (CFC 12) 2 for 20 sec., and dried at a normal temperature.
(2) dipped in Flon R113 (CFC 12) 2 for 3 minutes, and dried at a normal temperature.
(3) dipped in Flon R113 (CFC 12) 2 for 4 minutes, and dried at a normal temperature.
(4) dipped in Flon R113 (CFC 12) 2 for 5 minutes, and dried at a normal temperature.
(5) dipped in Flon R113 (CFC 12) 2 for 2 minutes, and dried at a normal temperature.
Ts . . . the temperature of the organic photosensitive layer
* . . . 13.56M

What is claimed is:

1. A photosensitive member comprising a conductive substrate; an organic photosensitive layer formed on the conductive substrate, which comprises an organic charge-generating material, an organic charge-transporting material, a binder resin and a solvent at a content of 2,500 to 20,000 ppm; and a surface protective layer formed on the organic photosensitive layer, which comprises an amorphous hydrocarbon having an absorptivity coefficient of 400 to 5,000 $cm^{-1}$ with respect to light of 450 nm wavelength.

2. A photosensitive member as claimed in claim 1, wherein the organic photosensitive layer comprises a charge-generating layer and a charge-transporting layer.

3. A photosensitive member as claimed in claim 1, wherein the surface protective layer comprises an amorphous hydrocarbon having an absorptivity coefficient of 1,000 to 4,000 $cm^{-1}$ with respect to light of 450 nm wavelength.

4. A photosensitive member as claimed in claim 1, wherein the surface protective layer is 0.01 to 5 μm in thickness.

5. A photosensitive member as claimed in claim 4, wherein the surface protective layer is 0.04 to 1 μm in thickness.

6. A photosensitive member as claimed in claim 1, wherein the absorptivity coefficient $\alpha$ ($cm^{-1}$) with respect to light of 450 nm wavelength, and the thickness d (μm) of the surface protective layer have a relationship satisfying the following formula:

$$\alpha \times d \leqq 2{,}230.$$

7. A photosensitive member comprising a conductive substrate; an organic photosensitive layer formed on the conductive substrate, which comprises an organic charge-generating material, an organic charge-transporting material, a binder resin and a solvent at a content of 2,500 to 20,000 ppm; and a surface protective layer formed on the organic photosensitive layer, which comprises an amorphous hydrocarbon produced by means of a plasma chemical vapor deposition technique which satisfies the following relationship:

$$0.005 \leqq \text{supplied electric power}/(\text{material gas introduction amount} \times \text{pressure}) \leqq 0.15$$

in which the respective units are W for the supplied electric power, sccm for the material gas introduction amount, and Torr for the pressure.

* * * * *